US005492327A

United States Patent [19]

Biafore, Jr.

[11] Patent Number: 5,492,327

[45] Date of Patent: Feb. 20, 1996

[54] SHOCK ABSORBING IRON HEAD

[75] Inventor: John J. Biafore, Jr., Shelby Township, Mich.

[73] Assignee: Focus Golf Systems, Inc., Clinton Township, Mich.

[21] Appl. No.: 342,601

[22] Filed: Nov. 21, 1994

[51] Int. Cl.[6] ..... A63B 53/04

[52] U.S. Cl. ..... 273/173; 273/167 F

[58] Field of Search ..... 273/167 R, 167 H, 273/167 J, 173, 171, 169, 167 F, 78, 77 A, 167 G, 167 A, 172, 167 C, 167 B, 167 E

[56] References Cited

U.S. PATENT DOCUMENTS

| | | | |
|---|---|---|---|
| D. 206,234 | 11/1966 | Sasse | D34/5 |
| D. 218,178 | 7/1970 | Solheim | D34/5 |
| D. 222,752 | 12/1971 | Cook | D34/5 |
| D. 226,319 | 2/1973 | Sanders | D34/5 |
| 2,968,486 | 1/1961 | Walton | 273/78 |
| 3,061,310 | 10/1962 | Giza | 273/78 |
| 4,655,459 | 4/1987 | Antonious | 273/171 |
| 4,740,345 | 4/1988 | Nagasaki et al. | 364/257 |
| 4,884,812 | 12/1989 | Nagasaki et al. | 273/173 |
| 5,011,151 | 4/1991 | Antonious | 273/164 |
| 5,046,733 | 9/1991 | Antonious | 273/77 |
| 5,076,585 | 12/1991 | Bouquet | 273/173 |
| 5,246,231 | 9/1993 | Antonious | 273/167 F |
| 5,277,423 | 1/1994 | Artus | 273/80 |
| 5,282,625 | 2/1994 | Schmidt et al. | 273/167 H |
| 5,290,036 | 3/1994 | Fenton et al. | 273/167 R |
| 5,299,807 | 4/1994 | Hutin | 273/173 |
| 5,301,946 | 4/1994 | Schmidt et al. | 273/167 H |
| 5,316,298 | 5/1994 | Hutin et al. | 273/78 |
| 5,328,184 | 7/1994 | Antonious | 273/169 |
| 5,330,187 | 7/1994 | Schmidt et al. | 273/169 |
| 5,344,150 | 9/1994 | Schmidt et al. | 273/167 H |
| 5,377,979 | 1/1995 | Cong | 233/78 |

*Primary Examiner*—Vincent Millin
*Assistant Examiner*—Steven B. Wong
*Attorney, Agent, or Firm*—Basile and Hanlon

[57] ABSTRACT

An iron type golf club head has a cavity in a back and a continuous recess extending into the top surface, toe and a portion of the sole along the perimeter of the club head. The recess and a back wall of the cavity are spaced from the front striking surface to provide a front striking surface of a general uniform thickness. A vibration damping material is inserted in the recess.

9 Claims, 2 Drawing Sheets

SHOCK ABSORBING IRON HEAD

FIELD OF THE INVENTION

The present invention relates to an iron golf club having a shock absorbing head and a construction to achieve an enlarging effect of the sweet spot.

BACKGROUND OF THE INVENTION

It is known in the industry that a golf club head joined to a shaft can transmit vibrational energy up the shaft to the player when the club head strikes a ball. These vibrations can be distracting to players as well as effecting the accuracy of the strike. Various vibration dampers have been proposed to eliminate this vibrational effect on the player.

U.S. Pat. No. 5,277,423 issued to Artus discloses a rigid tubular sleeve made of a visco-elastic material having a predetermined thickness and slidably connected to the shaft. The sleeve on the shaft serves as a vibration damping device by absorbing the energy released during the strike of a ball and converting it into heat.

Other means to dampen the vibrational energy of a golf club is to incorporate the visco-elastic material directly adjacent the surface of the club head wherein the damping material is located closer to the source of vibration. U.S. Pat. No. 5,290,036 issued to Fenton et al. discloses such a iron golf club wherein a vibration dampening material is set in the back cavity of the iron head. A problem that can be encountered with this damping location is that the damping material could also dissipate the energy of the striking ball and thereby diminish the efficiency of the hit.

Additionally, it was known in the industry to provide a perimeter weighted iron golf club head having a rear cavity in an attempt to provide a golf club head that improves off-center hits. Such iron heads are configured to redistribute the weight on the head, or to provide a uniform striking surface to maximize the performance of an off-center hit as well as an on-center hit.

U.S. Pat. No. 5,046,733 issued to Antonious provides a peripheral or perimeter weighted iron golf club head having a second peripheral weight member adjacent the first peripheral weight member to maximize off-center hits of the ball.

U.S. Pat. No. 5,282,625 issued to Schmidt et al. discloses a reconfigured iron head that achieves lateral sweet spot enlargement by providing undercuts at the toe and heel that extend outwardly from the rear cavity.

SUMMARY OF THE INVENTION

It is the object of the invention to provide an improved iron head having vibration damping means incorporated in the head such that it does not result in a loss of accuracy or efficiency when striking the ball. It is further another object of the invention to provide an iron head configuration that provides an enlarging effect of the sweet spot. It is also an object of the invention to provide an iron golf club set having these benefits that is easily manufactured.

The aforementioned objectives are accomplished by providing an iron golf club head having a front face and back surface, wherein the back surface has a forwardly extending rear cavity that is located directly behind the front face. The golf club head further comprises a top surface, a toe, a sole, and heel, which together define the perimeter of the iron head. A recess is provided along the perimeter of the iron head that extends along the top surface, toe and sole of the club head. The recess is positioned along the perimeter of the club head at a predetermined distance from the front face such that the front face has a known thickness. The recess is further cut to a depth such that it ends proximate to the rear cavity. As a result, the front face has a consistent thickness essentially over its entire surface to effect an enlargement of the sweet spot.

In addition, a vibrational damping means is incorporated into the iron head by inserting a viscoelastic polymer into the peripheral recess of the iron head. The damping effect of the polymer enforces the sweet spot enlargement by deadening the iron so that if the ball is hit off center, the of the ball does not significantly change. The damping means does not extend over the entire surface of the front face as in the prior art so that the damping means does not deaden the energy of the ball when struck by the iron golf club.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
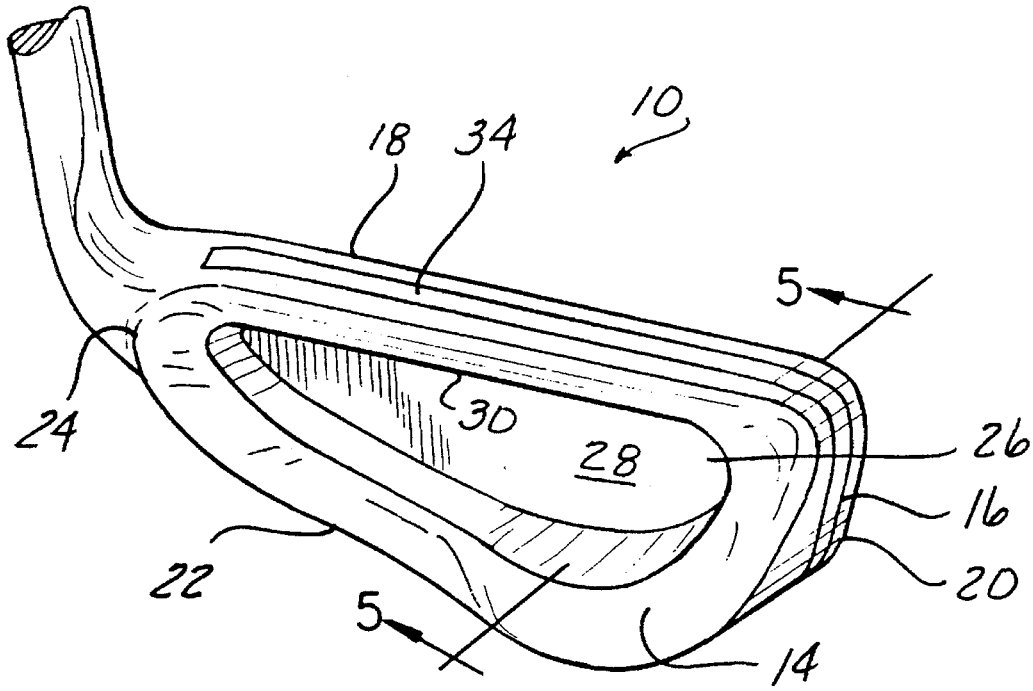
FIG. 1 is a perspective view of an iron type golf club head partially showing a recess along the perimeter of the head and a cavity in the back of the head.

Referring to FIGS. 1–5, the current invention is a perimeter weighted iron golf club head 10. The golf club head 10 has a front striking surface 12 and a back wall 14. It further has a perimeter 16 defined by a top surface 18, a toe 20, a bottom surface or sole 22 and a heel 24. The back wall 14 has a forwardly directed cavity 26, in which an inner wall surface 28 of the cavity 26 is essentially parallel with the front striking surface 12. An upper wall 30 of a cavity is essentially parallel to the top surface 18. The top surface 18 is essentially a flat wide surface having a width (W) dimension of approximately 0.25 mm, and remains a constant width from the heel 24 to the toe 20.

Figure 3:
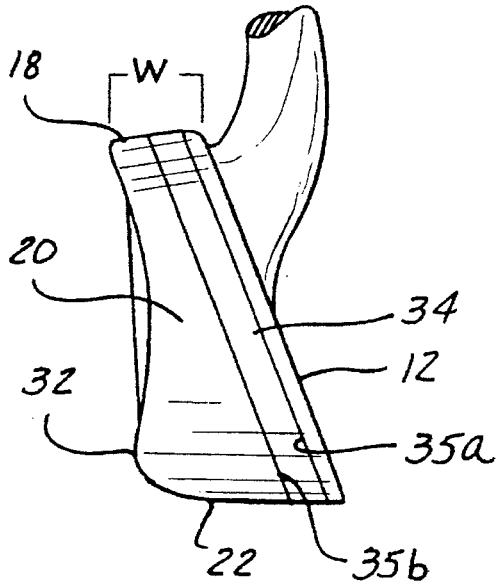
FIG. 3 is a toe view of the iron golf club head.
Figure 4:
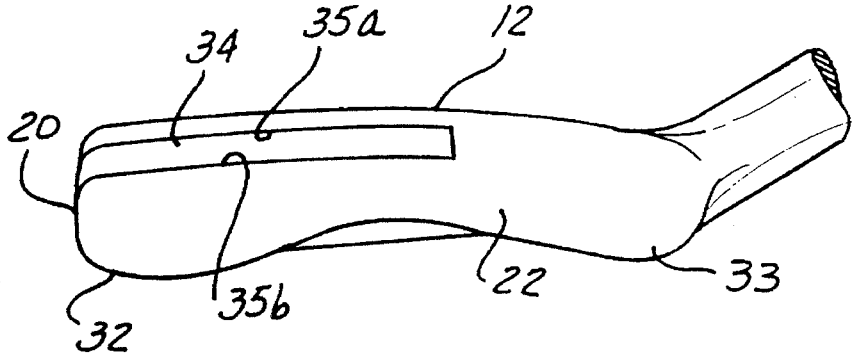
FIG. 4 is a sole or bottom view of the golf club head.

The toe 20, as seen in FIG. 3, has a mass 32 at the sole 22 that progressively decreases to a uniform thickness (W) as it extends up to the top surface 18. The heel 24, as seen in FIG. 4, has a smaller mass 33 at the sole 22 that decreases to the thickness (W) the top surface 18.

Figure 2:
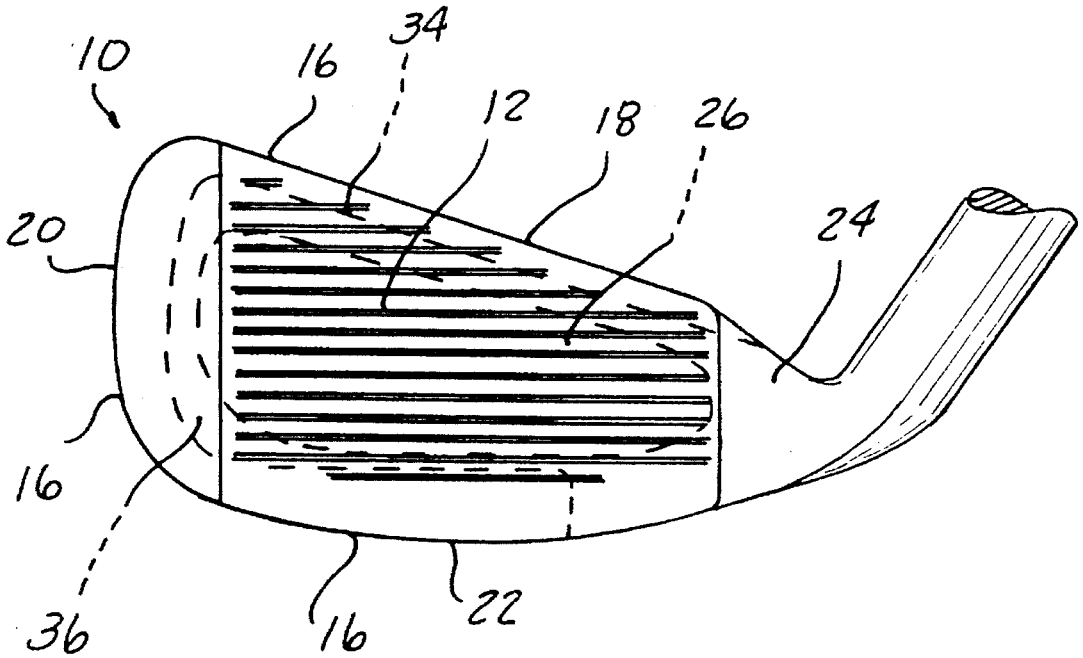
FIG. 2 is a front view of the golf club head.
Figure 5:
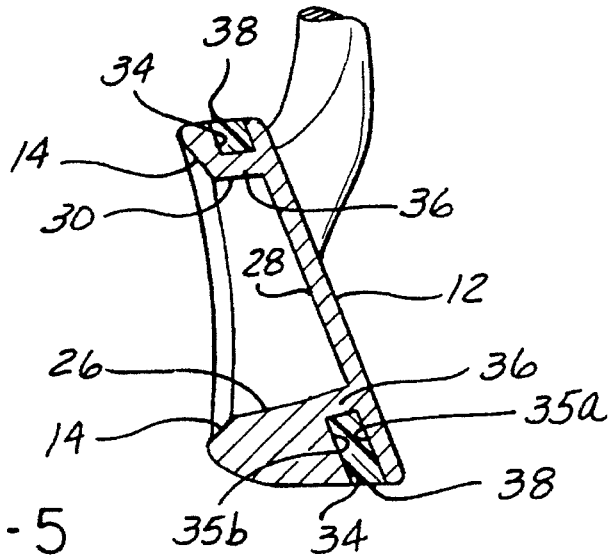
FIG. 5 is a section taken on lines 5—5 of FIG. 1.

Along the perimeter 16 of the iron club head 10 starting proximate to the heel 24 on the top surface 18 is a recess 34 along the top surface 18 and extending continuously around the toe 20 and continuing along the sole 22. The recess 34 ends at a point on the sole 22 spaced from the heel 24 of the golf club head 10. In the preferred embodiment, the recess has side walls 35*a*, 35*b* that are parallel to each other. As seen in FIGS. 2 and 5, the recess 34 extends to a depth within the iron head 10 proximate to the cavity 26 whereby a bridge 36 joins the front striking surface area 12 to the back wall area 14 along most of the perimeter 16 of the golf club head 10. As can be seen in FIGS. 3 and 5, the recess 34 is spaced from the front striking surface 12 at a distance consistent throughout its entire length around the perimeter 16. It is apparent from FIG. 5 that the recess 34 is spaced from the front striking surface 12 at a distance equal to the distance that the inner cavity wall 28 is spaced from the front striking surface 12. The recess 34 is angled to correspond to the angle of the front striking surface 12 so that the recess 34 is parallel with the front striking surface 12. In this manner, it is evident to see that the front striking surface 12 has a uniform thickness over most of its surface, an exception being at the portion where the bridge 36 connects the front striking surface 12 with the back wall 14 portion. Providing an essentially uniform thickness for the striking surface 12 allows for an enlarged sweet spot effect. The bridge is ideally a thickness of approximately 2.0 mm to provide adequate support for connecting the striking surface 12 and the back wall 14, but yet providing a maximum uniform thickness of the striking surface 12 over a greater portion of the surface area of the striking surface.

To provide a damping means to the golf club head 10, a visco-elastic material 38 having a high damping coefficient is inserted within the entire area of the recess 34, so that the damping material 38 is flush along the perimeter 16 of the golf club head 10. Typical visco-elastic materials that can be used are butyl rubber and other synthetic elastomers. The placement of the damping material 38 extending along the perimeter 16 of the golf club head 10 remedies problems encountered in the prior art. In the prior art when the visco-elastic material 38 was placed adjacent to the front striking face 12, excessive absorption of the energy from the ball impact was often observed resulting in a loss of efficiency. Having the damping material 38 along the perimeter 16 of the golf club head 10 minimizes the surface area of the striking surface 12 having ball impact with the damping material 38, but will effectively dampen the vibration to the player. In the preferred embodiment, the width of the recess 34 and thereby the thickness of the visco-elastic material 38 is approximately 5.0 mm, although the thickness may vary.

Providing an outer perimeter recess 34 to effect an enlarged sweet spot on the front striking surface 12 provides an economic advantage over the prior art. The positioning of the recess allows the recess 34 to be cast in the golf club head 10 during the manufacturing process rather than cut into the cavity 34 afterwards as done in the prior art. The visco-elastic material 38 can then be easily inserted into the recess 34 with appropriate and conventional adhesives.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An iron-type golf club head having a perimeter defined by a top surface, toe, sole and heel, and having a front striking face and a rear wall, a portion of said perimeter having a recess located rearwardly from the front striking face and having a visco-elastic material disposed in said recess, wherein said material extends around said top surface, toe and sole.

2. The iron-type golf club head of claim 1 wherein the recess extends essentially parallel to the striking face.

3. The iron-type golf club head of claim 2 wherein the rear wall defines a cavity, said cavity having an inner surface that defines the opposite surface of the front striking face, wherein said recess extends proximate to the cavity.

4. The iron-type golf club head of claim 3 wherein the recess extends continuously along the top surface, toe and a portion of the sole and spaced from the front striking surface at essentially the same distance as the spaced distance of the inner surface of the cavity and the front striking surface.

5. An iron-type golf club head comprising an external top flat surface having a predetermined width, a toe, sole and heel, a front striking face and a rear wall, said rear wall having a cavity, said cavity having an inner surface that defines an opposite surface parallel to the front striking face;

said club head having a continuous recess located in the external top flat surface and extending around the toe and sole, said recess extending to a depth into the golf club head proximate to the cavity, wherein a visco-elastic material is disposed in the continuous recess and the material extends around said top surface,toe and sole;

said recess and cavity separated by a bridge encircling the cavity that connects the front striking face with the rear wall.

6. The club head of claim 5 wherein the inner surface of the cavity is parallel to the front striking surface.

7. The club head of claim 6 wherein the recess extends into the golf club at an angle equal to the angle of the front striking surface.

8. The club head of claim 7 wherein the recess has parallel side walls.

9. An iron-type golf club head comprising a top flat surface having a predetermined width, a toe, sole and heel, a front striking face and a rear wall, said rear wall having a cavity, said cavity having an inner surface that defines an opposite surface of the front striking face, wherein the inner surface of the cavity is parallel to the front striking surface;

said club head having a continuous recess located in the top surface and extending to the toe and sole, said recess extending to a depth into the golf club head proximate to the cavity and at an angle equal to the angle of the front striking surface wherein said recess has parallel side walls and a visco-elastic material is inserted in the continuous recess so that the material is flush with the top surface, toe and sole.

* * * * *

UNITED STATES PATENT AND TRADEMARK OFFICE

CERTIFICATE OF CORRECTION

PATENT NO. : 5,492,327

DATED : February 20, 1996

INVENTOR(S) : John J. Biafore, Jr.

It is certified that error appears in the above-indentified patent and that said Letters Patent is hereby corrected as shown below:

Column 1, line 14, delete "effecting" and insert --affecting--

Column 1, line 28, delete "a" and insert --an--.

Column 1, line 32, delete "striking" and insert --struck--.

Column 2, line 47, delete "a".

Column 2, line 47 after "cavity" insert --26--.

Column 2, line 50, delete "mm" and insert --inch--.

Column 3, line 20, after "surface" second accurrence, insert --12--.

Column 3, line 45, delete "34" and insert --26--.

Column 4, line 16, after "sole and" insert --is--.

Column 4, line 16, delete "surface" and insert --face--.

Column 4, line 18, delete "surface" second occurrence and insert --face--.

Column 4, line 36, delete "surface" and insert --face--.

Column 4, line 38, after "golf club" insert --head--.

Column 4, line 39, delete "surface" and insert --face--.

Column 4, line 48, delete "surface" and insert --face--.

UNITED STATES PATENT AND TRADEMARK OFFICE

CERTIFICATE OF CORRECTION

PATENT NO. : 5,492,327

DATED : February 20, 1996

INVENTOR(S) : John J. Biafore, Jr.

It is certified that error appears in the above-indentified patent and that said Letters Patent is hereby corrected as shown below:

Column 4, line 53, delete "surface" and insert --face--.

Signed and Sealed this

Eighth Day of October, 1996

*Attest:*

Bruce Lehman

BRUCE LEHMAN

*Attesting Officer*

*Commissioner of Patents and Trademarks*